US005954108A

United States Patent [19]

Oda et al.

[11] Patent Number: 5,954,108

[45] Date of Patent: Sep. 21, 1999

[54] DRIVE UNIT FOR A VERTICAL BLIND

[75] Inventors: Zenichi Oda; Akinori Kimata, both of Anjo, Japan

[73] Assignee: Makita Corporation, Anjo, Japan

[21] Appl. No.: 08/787,825

[22] Filed: Jan. 28, 1997

[30] Foreign Application Priority Data

Feb. 19, 1996 [JP] Japan ..... 8-030815

[51] Int. Cl.[6] ..... E06B 9/36

[52] U.S. Cl. ..... 160/168.1 P; 160/176.1 P

[58] Field of Search ..... 160/176.1 P, 168.1 P, 160/321, 344, 900, 176.1 V, 168.1 V

[56] References Cited

U.S. PATENT DOCUMENTS 4,844,139 7/1989 John .

4,896,713 1/1990 Rademacher .

4,914,360 4/1990 Hsieh et al. ..... 160/168.1 P X 5,266,068 11/1993 Benthin ..... 160/168.1 P X

*Primary Examiner*—Blair Johnson

*Attorney, Agent, or Firm*—Davis and Bujold

[57] ABSTRACT

A drive unit for a vertical blind having a housing with a louver traverse drive shaft with a loop string wound therearound, a louver tilt drive shaft with a loop chain wound therearound, a louver open detection means with a slider and a switch to be turned on and off by the slider, and a control means for rotating the louver traverse drive shaft once a neutral position of the louvers is detected.

5 Claims, 13 Drawing Sheets

[OFF]

[ON ↔ OFF]

[ON]

DRIVE UNIT FOR A VERTICAL BLIND

FIELD OF THE INVENTION

This invention relates to a drive unit for a vertical blind.

BACKGROUND OF THE INVENTION

In a vertical blind disclosed in U.S. Pat. No. 4,844,139, to effect traverse of louvers along a guide member, each louver is first rotated to a neutral position almost perpendicular to the guide member. Another vertical blind proposed in U.S. Pat. No. 4,896,713 can be operated with an electromotive motor or can be remote controlled.

In the motor-driven vertical blind, it is necessary to detect whether or not the louver is in the neutral position, such that the louver is prevented from traversing when the louver is not in the neutral position. For example, in a detection mechanism shown in FIG. 13, a drive shaft 101 of a pulley with a louver operating loop wound around is provided with a projection 103. When limit switches 105 and 107 provided at opposite sides of the drive shaft 101 contact the projection 103, a 0 degree position and a 180 degree position, at which the louver is closed, can be detected, respectively. In such vertical blind, the drive shaft 101 is first rotated to the position where the limit switch 105 or 107 turns on, and is then rotated in reverse by 90 degrees, thereby rotating the louver to the neutral position before transversely moving the louver.

In the conventional vertical blind, at least two limit switches are required for detecting that the louver is in the neutral position, disadvantageously increasing the number of components.

Even though the louver is rotatable between the 0 degree position and the 180 degree position, the limit switches 105 and 107 prevent the drive shaft 101 from completing additional rotational movement. Therefore, the rotation ratio of the pulley must be carefully designed to vary with the loop operation amount necessary for rotating the louver 180 degrees. The conventional vertical blind lacks versatility.

Furthermore, when the louver is between the 0 degree position and the 180 degree position, it cannot be detected instantly whether or not the louver is in the neutral position. By rotating the louver to the 0 or 180 degree position, the 0 or 180 degree position must be once detected, and then the louver must be rotated from the detected position in reverse by 90 degrees. Such operation of the louver is laborious.

SUMMARY OF THE INVENTION

Wherefore, an object of the present invention is to provide a drive unit for a vertical blind having an increased versatility and a reduced number of components and facilitating operation.

To attain this and other objects, the present invention provides a drive unit of a vertical blind provided with a louver tilt drive shaft with an operation loop wound therearound for rotating louvers about a vertical axis, a louver traverse drive shaft with an operation loop for effecting traverse of said louvers along a guide, a louver open detector provided in the vicinity of the louver tilt drive shaft for detecting that the louvers are rotated to a neutral position, and a controller for driving the louver traverse drive shaft after it is detected by the louver open detector that the louvers are in the neutral position. The louver open detector is provided with a slider for being slid along an axial direction when the louver tilt drive shaft is rotated and a switch for being turned on or off by the slider. The slider has a thread groove to be screwed with a thread formed on the outer periphery of the louver tilt drive shaft for controlling rotation of the slider, such that the slider is slid in an axial direction when the louver tilt drive shaft is rotated. When the position of the slider relative to that of the switch is set such that the switch turns on or off at the neutral position of the louvers, only one switch is required for detecting the neutral position of the louvers, thereby decreasing the number of components. In the drive unit, when the louver traverse drive shaft is actuated by the controller, the louver tilt drive shaft is rotated while searching a point, at which the switch is changed over from its ON condition to its OFF condition or from its OFF condition to its ON condition. After placing the louvers into the neutral position, the louver traverse drive shaft is driven.

The neutral position of the louvers corresponds to an angular position, from which the louvers can be displaced to open the vertical blind. Specifically, at the neutral position the louvers are rotated by 90 degrees to be substantially perpendicular to a window frame.

In the drive unit of the present invention, by turning on or off the switch with the slider, the neutral position of the louvers is located. Therefore, the louver tilt drive shaft is rotated many times without problem, while the louvers are rotated between 0 and 180 degrees. Every time the vertical blind is mounted, it is not unnecessary to change the diameter ratio of pulleys, and only the positional relationship between the slider and the switch is adjusted. Therefore, the vertical blind provides a higher versatility than that of the conventional vertical blind.

Since the switch is turned on or off at the neutral position of the louvers, the neutral position of the louvers can be detected by rotating the louver tilt drive shaft only in one axial direction. Specifically, when the switch is turned off, the louver tilt drive shaft is rotated in an axial direction such that the switch turns on, and the point at which the switch turns on is searched. To the contrary, when the switch is turned on, the point at which the switch turns off is searched by rotating the louver tilt drive shaft in an axial direction such that the switch turns off. The operation for detecting the neutral position of the louvers can thus be facilitated. Especially, the louvers are in the vicinity of the neutral position, the neutral position can be detected by rotating the louver tilt drive shaft slightly, and subsequently traverse of the louvers can be quickly effected. In the conventional drive unit, operation of the louver from the 0 degree position to the 180 degree position is especially laborious when the louvers are in the vicinity of the neutral position. In this case, however, the present invention is especially advantageous.

BRIEF DESCRIPTION OF THE DRAWINGS

The invention will now be described with reference to the drawings, in which.

DETAILED DESCRIPTION OF THE PREFERRED EMBODIMENTS

Figure 1:
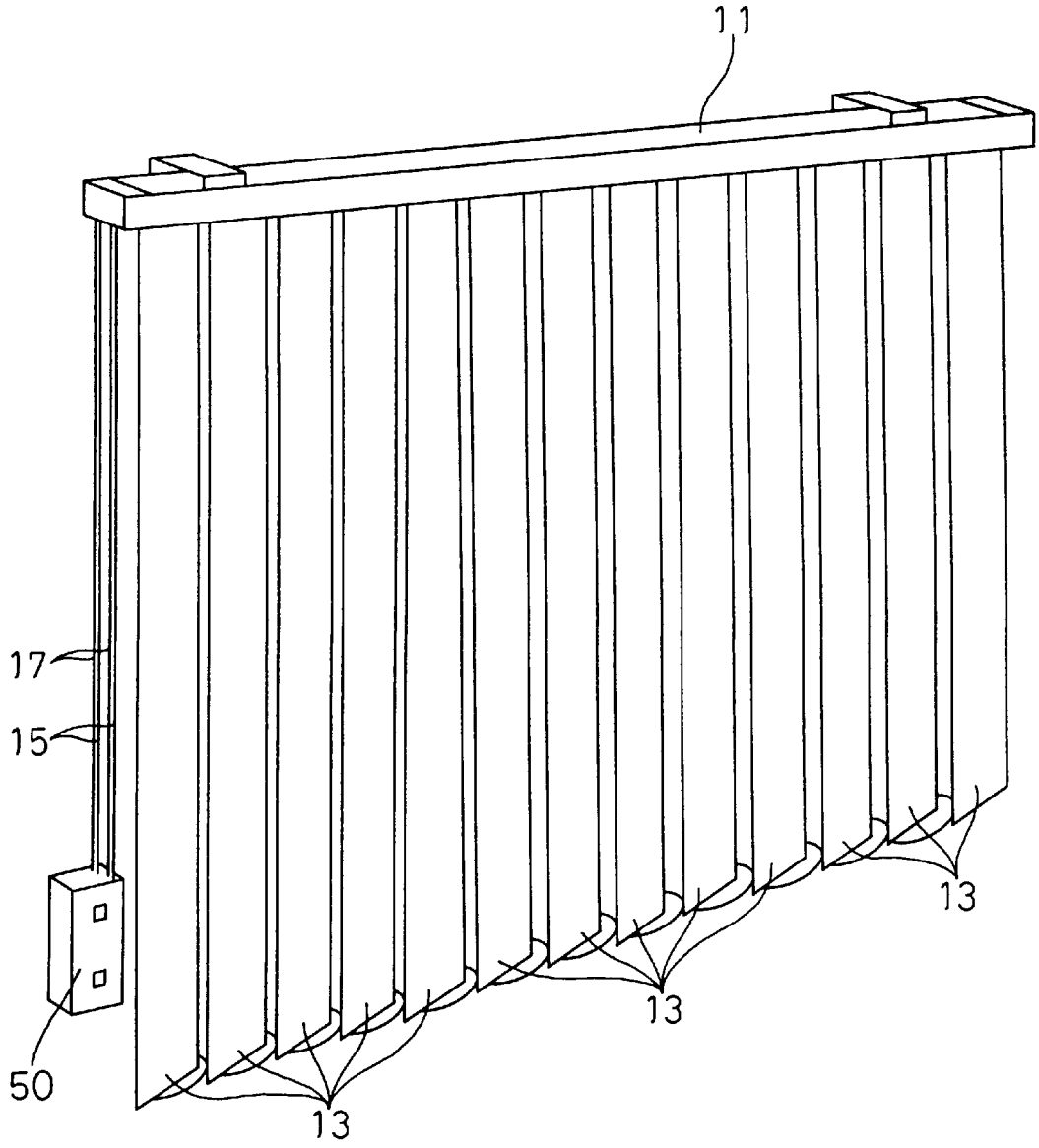
FIG. 1 is a perspective view of a vertical blind provided with a drive unit embodying the invention.

In an embodiment shown in FIG. 1, a vertical blind is provided with a guide 11 extending horizontally along a top of a window frame, a plurality of louvers 13 vertically hanging on the guide 11, a loop chain 15 for rotating the louvers 13, a loop string 17 for displacing the louvers 13 and a drive unit 50 for driving the loop chain 15 and the loop string 17.

Figure 2A:
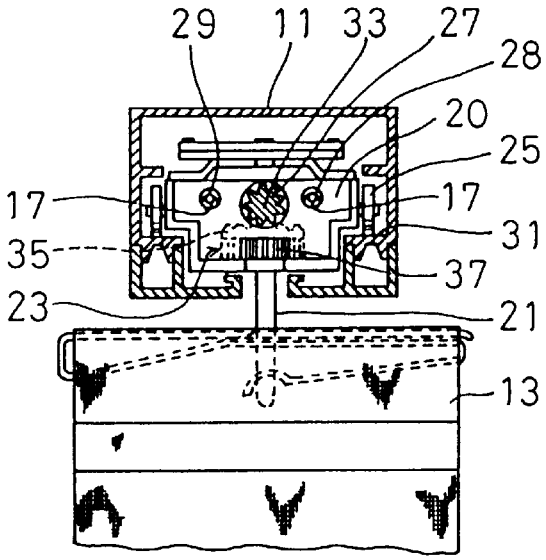
FIGS. 2A and 2B are partial cross-sectional views of the vertical blind seen from the right side and the top thereof, respectively.

As shown in FIG. 2, a plurality of carriers 20, housed in the guide 11, are each provided with a hook 21 for holding the louvers 13, a hook rotation mechanism 23 for rotating the hook 21 about a vertical axis and opposed rollers 25 for reciprocating the carrier 20. Also, a rolling contact member or hanger rail 31 is projected inwardly from a side wall 30 of the guide 11 for supporting the opposed rollers 25 of the carrier 20.

In the vertical blind, an insertion hole 27 is formed substantially in the center of each carrier 20 which receives a rotatable spline shaft 33 for operating the hook rotation mechanism 23. The hook rotation mechanism 23 is composed of a rack 35 having axial teeth facing upwardly to engage with the outer periphery of the spline shaft 33 and radial teeth facing out of the page, as viewed in the figure, to engage with a pinion gear 37 of the hook 21. The loop chain 15 is wound around a pulley 39 attached to one end of the spline shaft 33. By operating the loop chain 15, the spline shafts 33 are rotated and the louvers 13 are then rotated about the vertical axis.

Two small holes 28 and 29 are formed in the carrier 20 on opposite sides of the insertion hole 27, such that the loop string 17 reciprocates through the small holes 28 and 29. However, the loop string 17 is secured in such small hole 28 or 29 of a lead carrier 20L by tying the loop string 17 and making knots 17*a* and 17*b* on the loop string 17 at the opposite sides of the small hole 28 or 29. Therefore, by reciprocating the loop string 17, the lead carrier 20L can be moved along the guide 11.

Figure 2B:
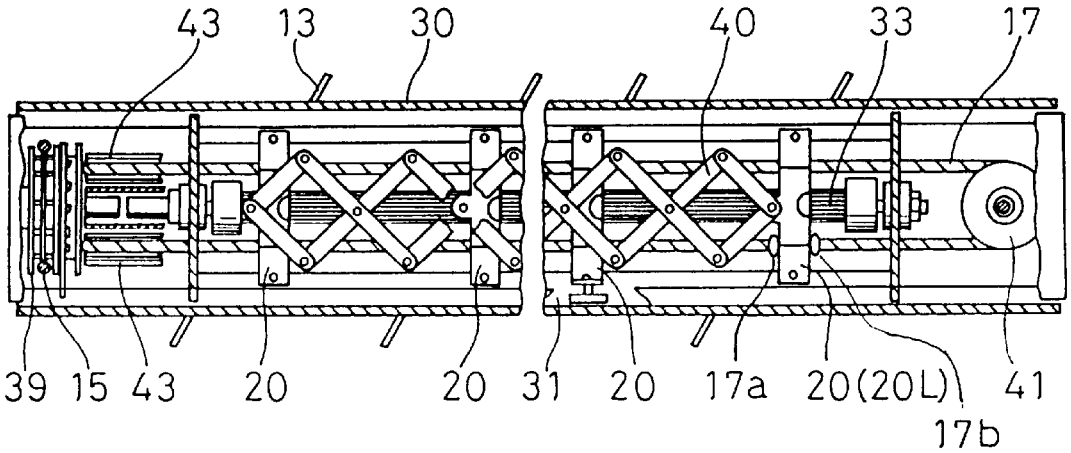

The carriers 20 including a lead carrier 20L are interconnected by a pantograph-shaped connector 40, such that the carriers 20 reciprocate with a distance therebetween in the guide 11 along with reciprocation of the lead carrier 20L. As shown in FIG. 2B, the loop string 17 is wound around a horizontal pulley 41 attached to one end of the guide 11 and vertical pulleys 43 opposed at the other end of the guide 11, and hangs down.

Figure 3:
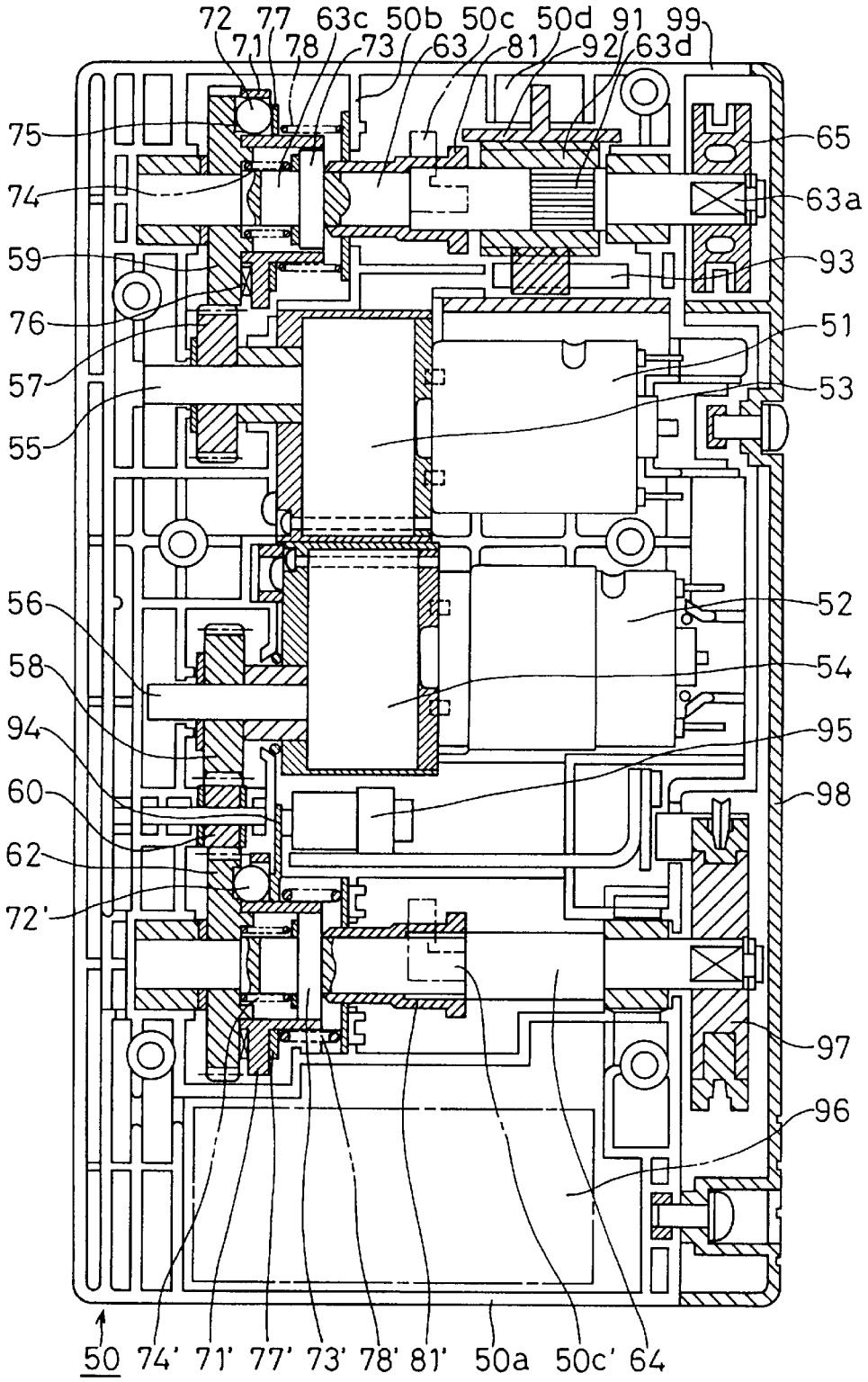
FIG. 3 is a cross-sectional view of the drive unit seen from the front thereof.

As shown in FIG. 3, the drive unit 50 is composed of a housing 50*a* consisting of two halves for accommodating a tilt motor 51, shown above in the figure, for rotating the louvers 13 and a traverse motor 52, shown below in the figure, for traversing the louvers 13.

The motors 51 and 52 are attached to reduction gear boxes 53 and 54, from which output shafts 55 and 56 are extended, respectively. A louver tilt drive shaft 63 for the loop chain 15 is connected via two gears 57 and 59 to the output shaft 55 of the tilt motor 51, while a louver traverse drive shaft 64 for the loop string 17 is connected via three gears 58, 60 and 62 to the output shaft 56 of the traverse motor 52.

Figure 4:
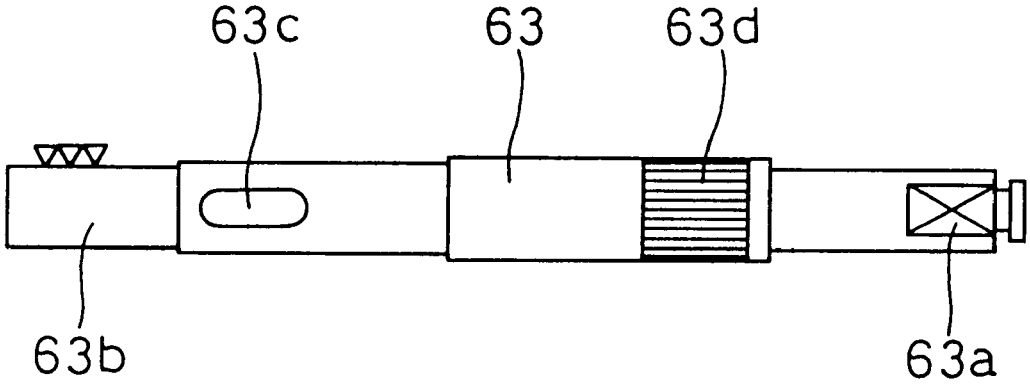
FIG. 4 is a plan view of a louver tilt drive shaft for use in the embodiment.

A pulley 65 with the loop chain 15 wound therearound is secured to the right end, as viewed in the figure, of the louver tilt drive shaft 63. The pulley 65 is engaged with a chamfered portion 63*a* formed in the right end, as viewed in the figure, of the louver tilt drive shaft 63. As shown in FIG. 4, a portion 63*b* with the gear 59 mounted thereon is precisely finished cylindrically as shown by a finishing code, and does not fit the gear 59. Therefore, the gear 59 is freely rotatable relative to the louver tilt drive shaft 63. The rotation of such free gear 59 is transmitted via a clutch mechanism to the louver tilt drive shaft 63.

Figure 5A:
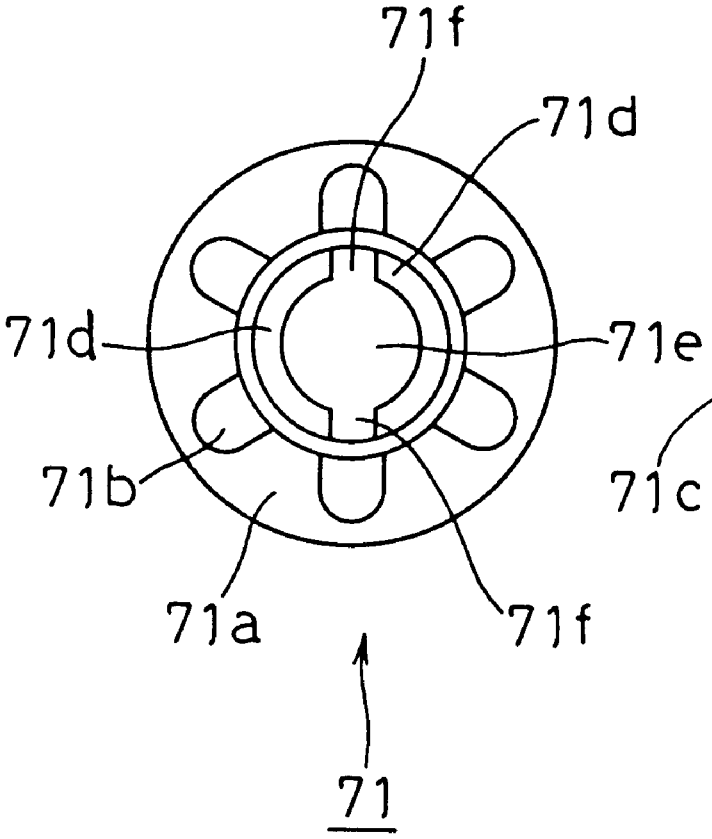
FIGS. 5A and 5B are a left side view and a cross-sectional view seen from the front of a retainer for use in the embodiment.
Figure 5B:
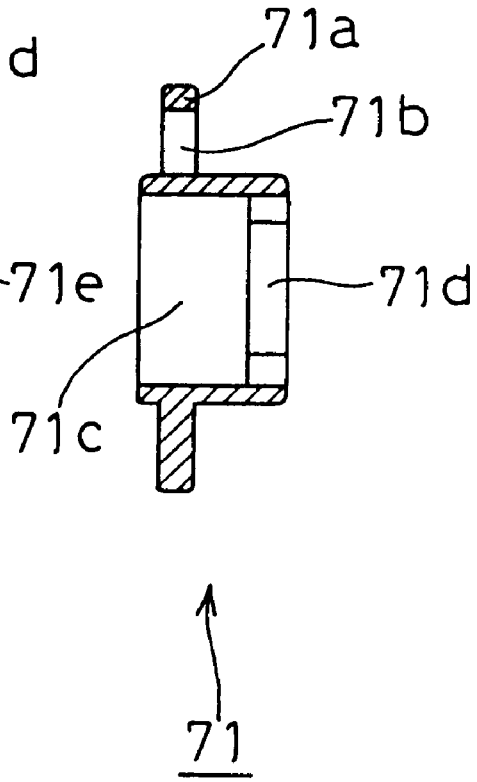

In the clutch mechanism a retainer 71 engaged with play with the louver tilt drive shaft 63 is connected via a steel ball 72 to the free gear 59. As shown in FIG. 5A, the retainer 71 has six holes 71*b* in a frame 71*a* for retaining the steel ball 72, and, as shown in FIG. 5B two jutted portions 71*d* are extended from the inner peripheral end in a central hole 71*c*. As shown in FIG. 5A, a hole 71*e* having a modified cross section is formed by the jutted portions 71*d*. Slits 71*f* extended vertically from the hole 71*e* are opposed to each other at a distance sufficient for receiving a pin 73 passed through the louver tilt drive shaft 63.

As shown in FIG. 3, the pin 73 inserted through a longitudinal hole 63*c* in the louver tilt drive shaft 63 is biased by a coil spring 74 interposed between the louver tilt drive shaft 63 and the free gear 59, toward the right side as viewed in the figure. The pin 73, in the biased condition shown in FIG. 3, is in the hole 71*e* and engaged with the jutted portions 71*d* of the retainer 71, such that the retainer 71 and the louver tilt drive shaft 63 can be integrally rotated.

Referring again to FIG. 3, the free gear 59 has an indentation 75 and a projection 76 on a surface facing the retainer 71 for engaging with the steel ball 72. The steel ball 72 together with the retainer 71 is pressed against the free gear 59 by a flat washer 77 and a coil spring 78. The end of the coil spring 78 remote from the free gear 59 is supported by a rib 50*b* in the housing 50*a*.

Thus, the rotation of the free gear 59 is transmitted via the aforementioned clutch mechanism to the louver tilt drive shaft 63.

Figure 6A:
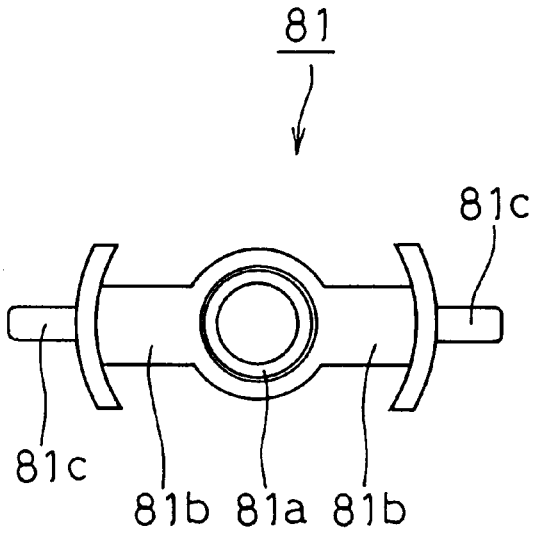
FIGS. 6A, 6B and 6C are a left side view, a partial cross-sectional view seen from the front, and a bottom view, respectively, of a sleeve for use in the embodiment.
Figure 6B:
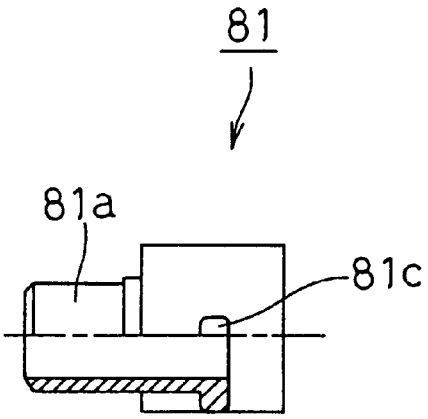
Figure 6C:
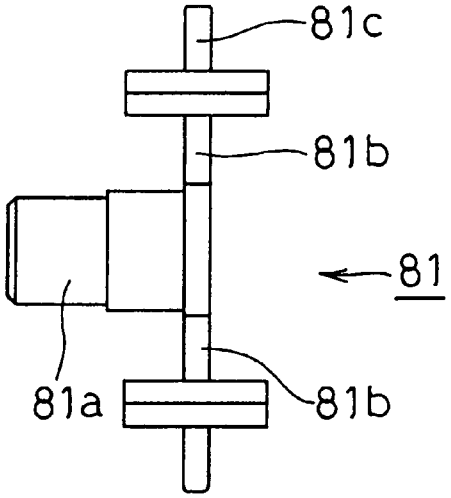

The clutch mechanism is connected and disconnected by sliding a sleeve 81 horizontally. As shown in FIGS. 6A, 6B and 6C, the sleeve 81 is composed of a cylindrical portion 81*a*, arms 81*b* projected from and attached to the end of the cylindrical portion 81*a* and levers 81*c* projected from the arms 81*b*.

Figures 7A, 7B:
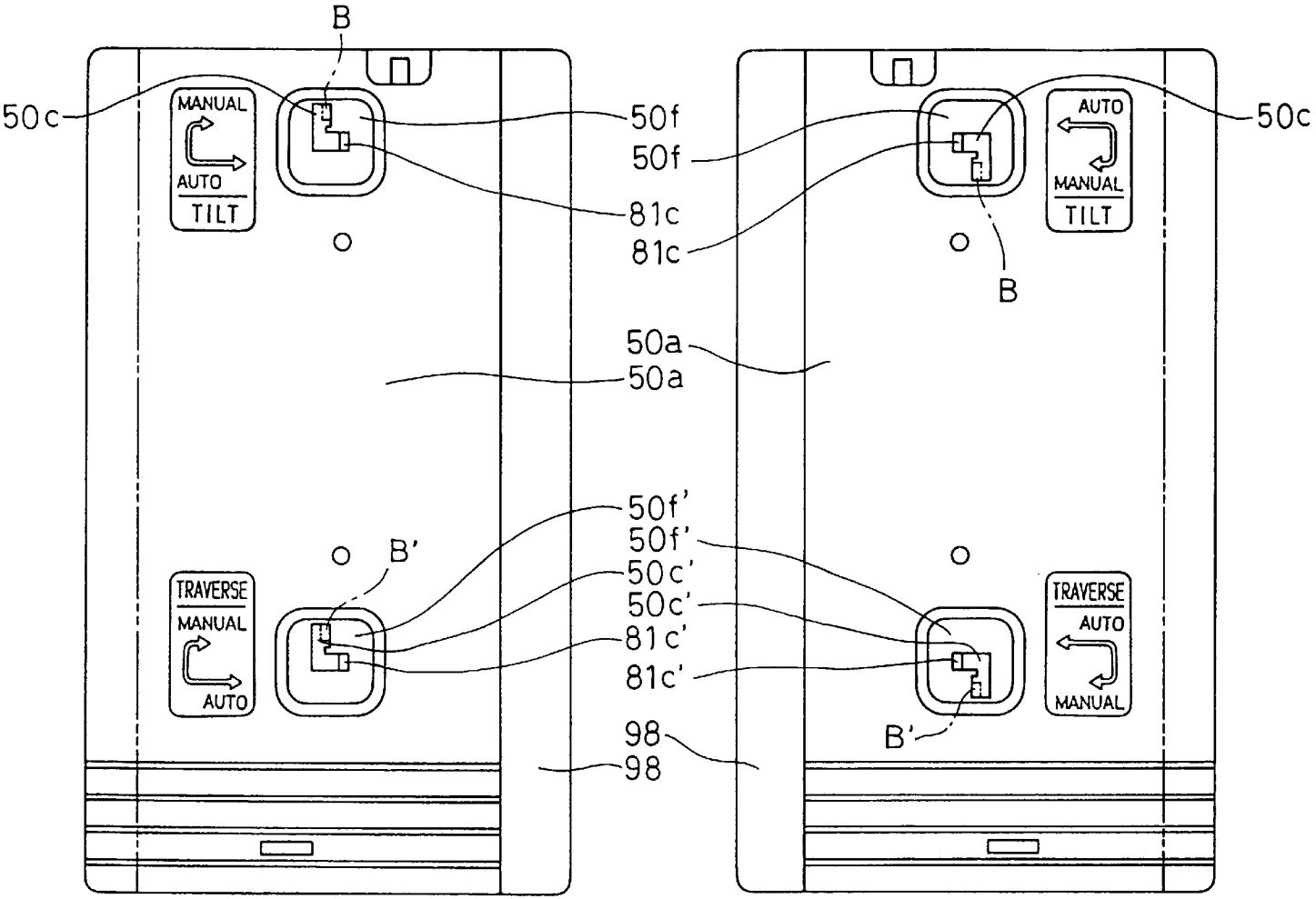
FIGS. 7A and 7B are a front view and a rear view, respectively, of the drive unit of the embodiment.
Figure 8A:
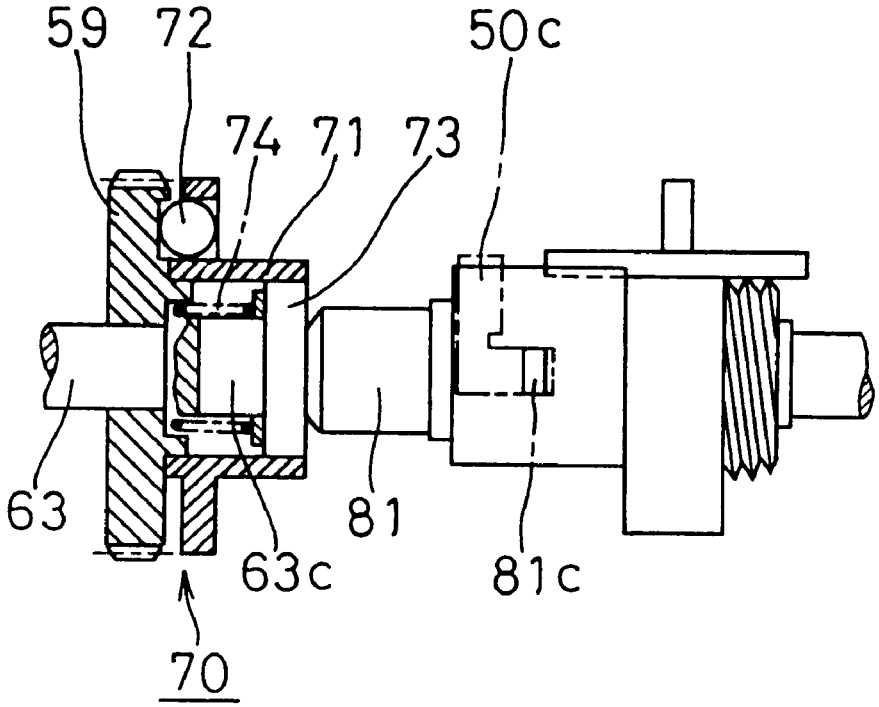
FIGS. 8A and 8B are explanatory views showing a clutch mechanism in the embodiment.
Figure 8B:
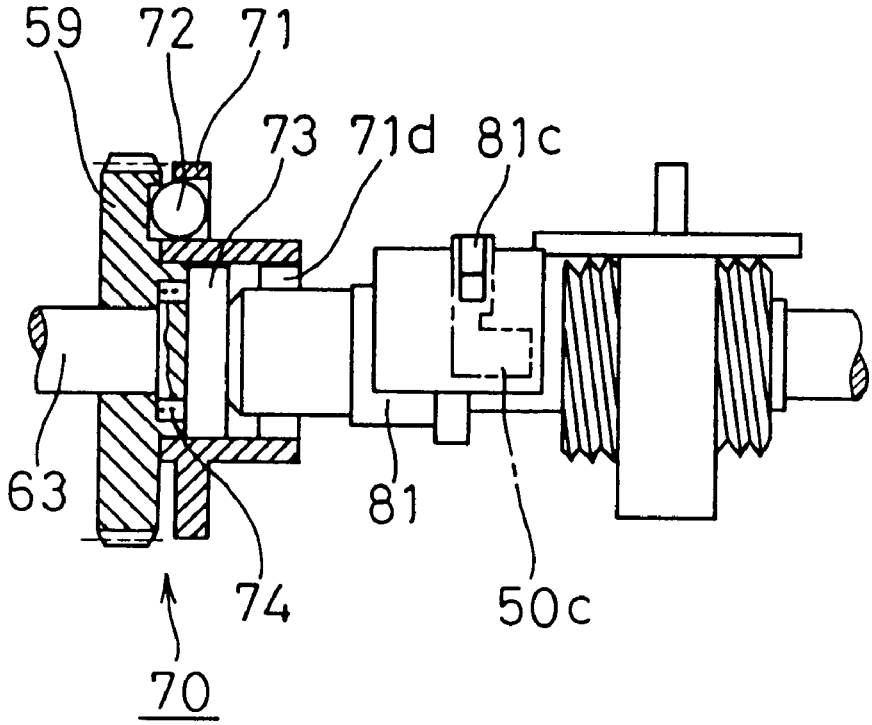
Figure 9A:
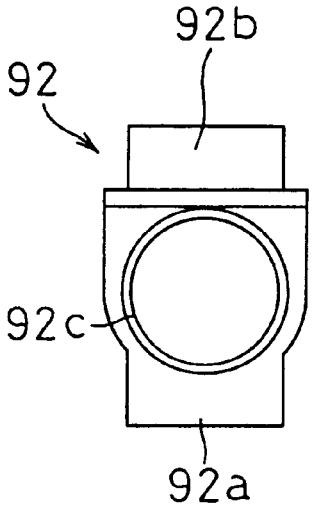
FIGS. 9A, 9B, 9C and 9D are a left side view, a front view, a right side view and a bottom view, respectively, of a slider for use in the embodiment.
Figure 9B:
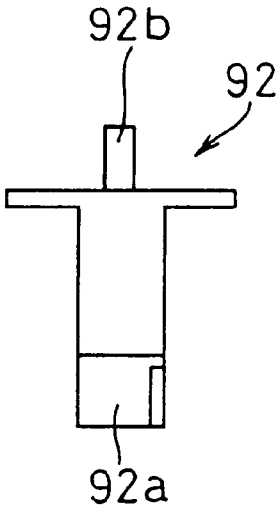
Figure 9C:
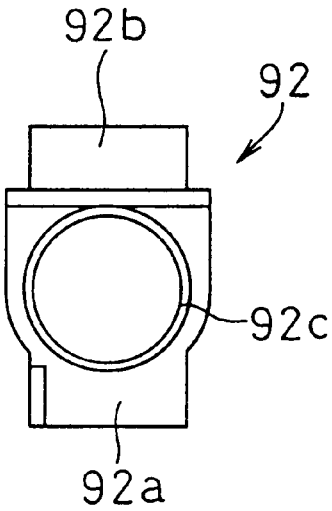
Figure 9D:
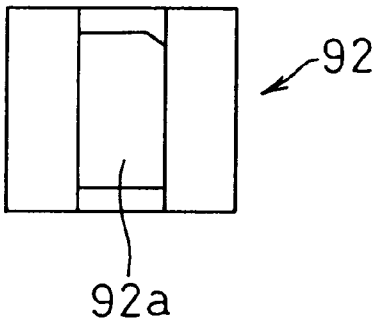

As shown in FIGS. 7A and 7B, the levers 81*c* are projected from hook-shaped openings 50*c* provided in front and rear faces, respectively, of the housing 50*a*. Each of the hook-shaped openings 50*c* is a continuation of horizontal and vertical grooves: the opening 50*c* in the front face is formed of the vertical groove continued to the horizontal groove at the right side as viewed in FIG. 7A; and the opening 50*c* in the rear face is formed of the horizontal groove continued to the vertical groove at the right side a viewed in FIG. 7B. When the levers 81*c* are cranked or operated to point B in the hook-shaped opening 50*c* shown in FIGS. 7A and 7B, the sleeve 81 and the pin 73 are changed from the condition shown in FIG. 8A to that shown in FIG. 8B. In FIG. 8A the clutch mechanism is connected, while in FIG. 8B the clutch mechanism is disconnected. By disconnecting the clutch mechanism, the louver tilt drive shaft 63 can be disengaged from the tilt motor 51.

The peripheral portions 50*f* around the hook-shaped openings 50*c* are indented from the front and rear faces of the housing 50*a*, respectively. Furthermore, since the levers 81*c* are not long enough to go beyond the front and rear faces of the housing 50*a*, either the front face or the rear face of the housing 50*a* can be in alignment with a wall.

Returning to FIG. 3, a louver neutral position detection mechanism provided on the louver tilt drive shaft 63 is composed of a screw 91 fixedly engaged with a knurled portion 63*d* of the louver tilt drive shaft 63, a slider 92 engaged with the screw 91 and a limit switch 93 to be turned on or off by sliding the slider 92.

As shown in FIGS. 9A–9D, the slider 92 is provided with a protrusion 92*a* for turning on or off the limit switch 93 and a projection 92*b* at the opposite side of the protrusion 92*a*. The projection 92*b* is fit in a guide groove 50*d* of the housing 50*a* for preventing the slider 92 from rotating, and has a thread groove 92*c* for engaging with the screw 91. While the louver tilt drive shaft 63 is rotated, the slider 92 is slid in an axial direction.

Figure 10C:
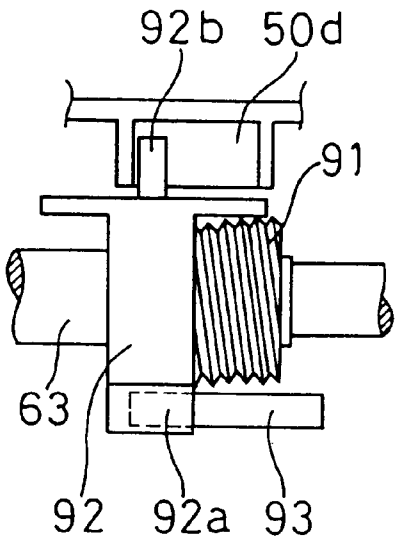
FIGS. 10A, 10B and 10C are explanatory views showing a neutral position detection mechanism in the embodiment.
Figure 10B:
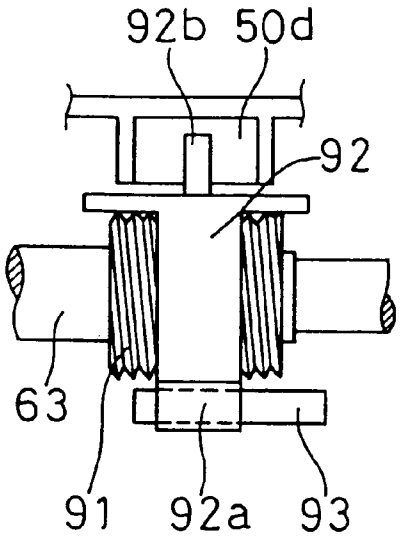
Figure 10A:
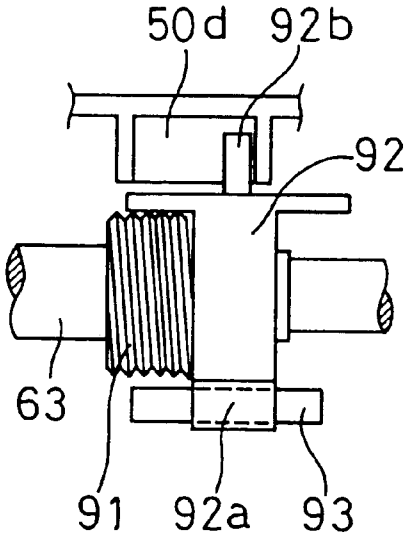

As shown in FIG. 10A, the limit switch 93 is turned on when the projection 92*b* of the slider 92 is fit with one end wall of the guide groove 50*d*. As shown in FIG. 10C, when the projection 92*b* is fit with the other end wall of the guide groove 50*d*, the limit switch 93 is turned off. When the projection 92*b*of the slider 92 is in the center of the guide groove 50*d*, the limit switch 93 is changed over.

Before the loop chain 15 is wound around the pulley 65, the loop chain 15 is manually operated to place the louvers 13 in the neutral position, and the louver tilt drive shaft 63 is rotated to place the slider 92 in the central position of the guide groove 50. The neutral position detection mechanism can thus be set, such that the limit switch 93 is turned off when the louvers 13 are rotated from an angular position at one side of the neutral position to the neutral position, and turned on when the louvers 13 are rotated in reverse from an angular position at the other side of the neutral position to the neutral position.

A clutch mechanism, identical in mechanical structure and operation manner to the aforementioned clutch mechanism, is also provided about the louver traverse drive shaft 64. The reference characters associated with the clutch mechanism for the louver traverse drive shaft 64 are like those of the clutch mechanism for the louver tilt drive shaft 63, except that they end with an apostrophe. A detailed explanation is omitted.

In the clutch mechanism for the louver traverse drive shaft 64, a lever 94 is provided on a flat washer 77' for bearing a retainer 71'. When the retainer 71' is moved apart from the free gear 62, a limit switch 95 is turned on by the lever 94. In this structure, it can be determined, by detecting movement of the retainer 71', that although the louvers 13 reach either end of the vertical blind, the louver traverse drive shaft 64 is further rotating or is overloaded.

A pulley 97, with the loop string 17 wound therearound, is attached to the end of the louver traverse drive shaft 64. The pulley 97 for the loop string 17 has a larger diameter than that of the pulley 65 for the loop chain 15. The loop chain 15 and the loop string 17 penetrate through a top opening 99 of a side cover 98.

The motors 51 and 52 are driven or controlled by a control circuit 96 housed in a lower part of the housing 50*a*. When tilt or traverse of the louvers 13 is instructed with a remote control switch (not shown), a control process is executed in the control circuit 96 as follows.

Figure 11:
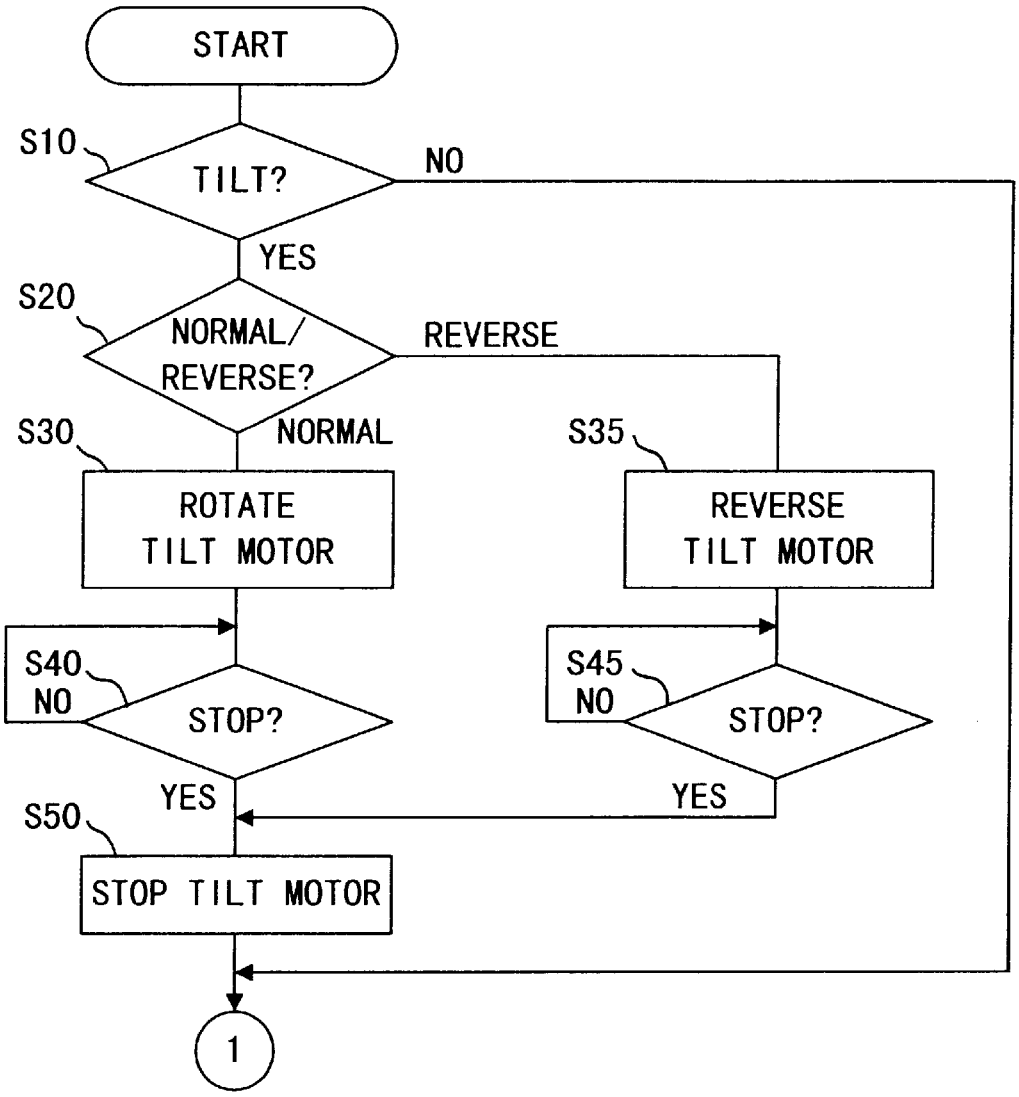
FIGS. 11 and 12 are flowcharts of a control procedure used in the embodiment.

Referring to the flowchart of FIG. 11, at step S10 it is determined whether an instruction to tilt the louvers 13 is given. If so, at step S20 it is determined whether an instruction is given to tilt the louvers 13 normally or in reverse. In the case of normal tilt, the tilt motor 51 is rotated normally at step S30, and in the case of reverse tilt, the tilt motor 51 is reversed at step S35. In either case, after it is determined at step S40 or S45 that an instruction is given to stop rotation of the tilt motor 51, the tilt motor 51 is stopped at step S50.

Figure 12:
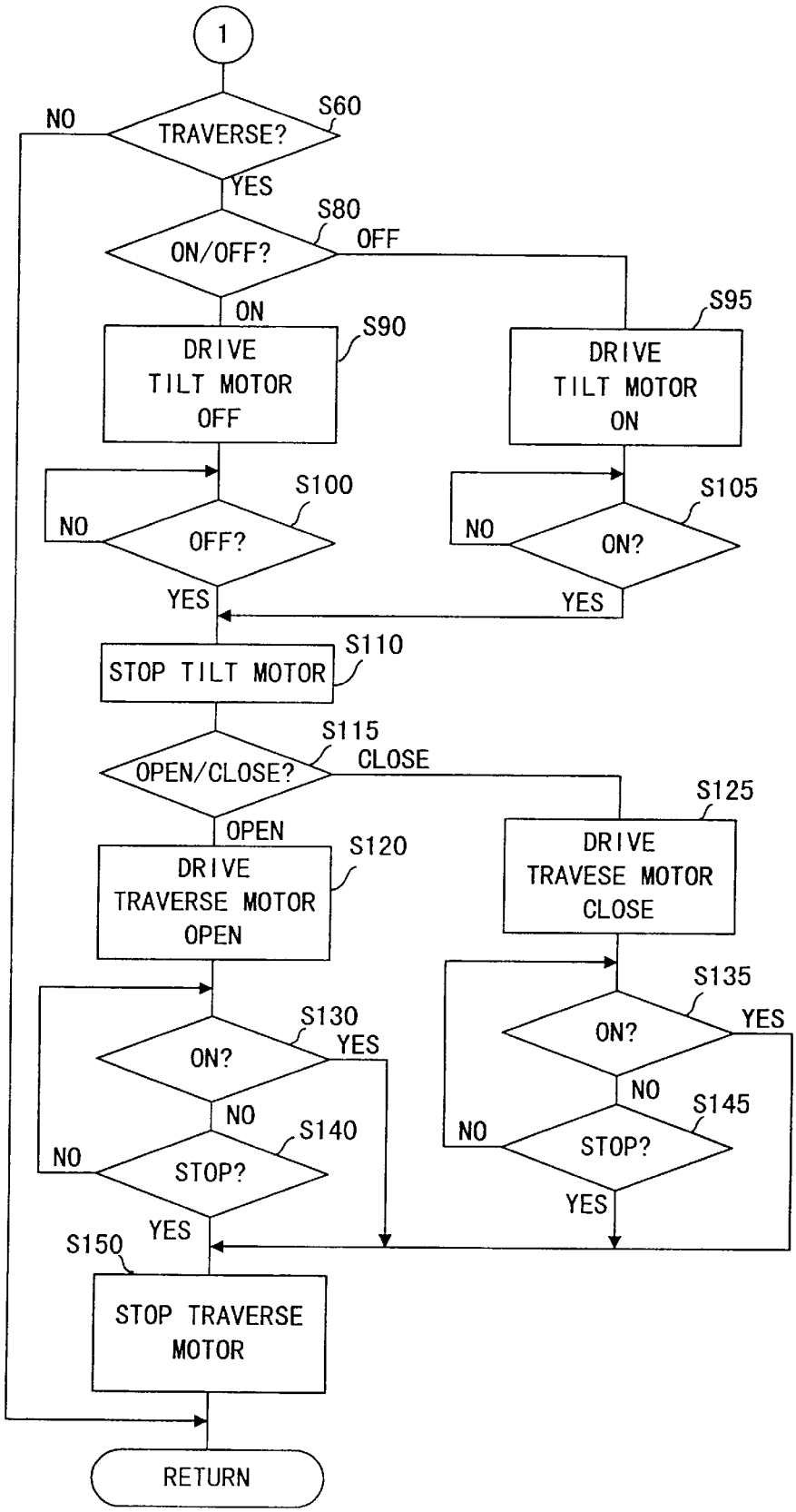
Figure 13:
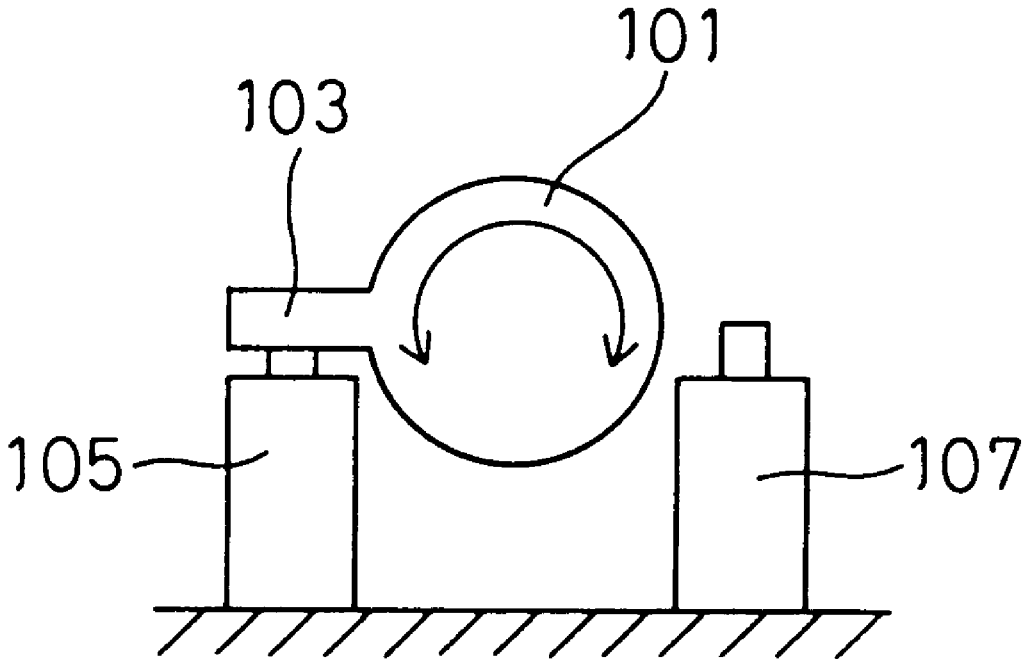
FIG. 13 PRIOR ART
FIG. 13 is an explanatory view of a prior-art neutral position detection mechanism.

Subsequently, as shown in the flowchart of FIG. 12, when it is determined at step S60 that an instruction to traverse the louvers 13 is given, it is determined at step S80 whether the limit switch 93 is turned on or off. When the limit switch 93 is turned on, the tilt motor 51 is driven in a direction such that the limit switch 93 is turned off at step S90. Subsequently, it is determined at step S100 whether or not the limit switch 93 is turned off. If the answer to step S100 is affirmative or if the limit switch 93 is changed over from its ON condition to its OFF condition, the tilt motor 51 is stopped at step S110. When it is determined at step S80 that the limit switch 93 is turned off, the tilt motor 51 is driven in a direction such that the limit switch 93 is turned on at step S95. Subsequently, it is determined at step S105 whether or not the limit switch 93 is turned on. If the answer to step S105 is affirmative or if the limit switch 93 is changed over from its OFF condition to its ON condition, the tilt motor 51 is stopped at step S110.

Subsequently, it is determined at step S115 whether the instruction for traversing the louvers 13 is given to close or open the vertical blind. In the case of opening the vertical blind, the traverse motor 52 is driven such that the vertical blind is opened at step S120. When the instruction of opening the vertical blind is given, the louvers 13 are already in the neutral position. Therefore, the louvers 13 can be easily opened without being interrupted by the adjoining louvers 13.

When it is determined at step S115 that the instruction of closing the vertical blind is given, the traverse motor 52 is driven such that the vertical blind is closed at step S125. Also when the instruction of closing the vertical blind is given, the louvers 13 are already in the neutral position. Therefore, the structure of the control circuit 96 is simplified.

After the traverse motor 52 is driven at step 120 or S125, it is determined at step S130 or S135 whether or not the limit switch 95 is turned on. If the answer to the step S130 or S135 is negative, it is determined at step S140 or S145 whether or not a stop instruction is given. If the answer to the step S140 or S145 is affirmative, the traverse motor 52 is stopped instantly at step S150. If it is determined at step S130 or S135 that the limit switch 95 is turned on, for example, when the louvers 13 reach either end of the vertical blind, the traverse motor 52 is prevented from rotating further. As a result, the retainer 71' and the free gear 62 are prevented from repeating engagement or disengagement and making rattling or uncomfortable noise.

When rotating the louvers 13, a user usually checks the condition of the louvers 13 visually, and remembers to give a stop instruction. Therefore, the steps like S130 and S135 for detecting an overload condition are omitted from the process of the louver tilt instruction.

As aforementioned, in the embodiment, when the louvers 13 are driven to traverse, opening the vertical blind, the louvers 13 are automatically rotated to be in the neutral position beforehand, thereby avoiding damage to the louvers 13. The louvers 13 can be rotated simply with one limit switch 93 which is turned on and off with the slider 92. The neutral position detection or control mechanism is thus simplified.

Since the limit switch 93 is turned on and off by the slider 92, the neutral position of the louvers 13 can be detected regardless of the ratio between the diameter of the pulley 39 at the side of the guide 11 and that of the pulley 65 mounted on the louver tilt drive shaft 63. The drive unit 50 can be mounted to conventional manually operated vertical blinds, thereby providing an improved versatility.

Furthermore, as aforementioned, the loop chain 15 can be easily set by operating the loop chain 15 such that the louvers 13 are in the neutral position and sliding the slider 92 to the center of the guide groove 50*d*.

To manually operate the vertical blind of the embodiment, the levers 81*c* and 81*c*' jutted from the hook-shaped openings 50*c* and 50*c*' in the housing 50*a* are cranked or operated to points B and B' shown in FIGS. 7A and 7B, thereby disconnecting the drive shafts 63 and 64 from the free gears 59 and 62, respectively. Therefore, the loop chain 15 and the loop string 17 can be manually operated without feeling the weight of the motors 51 and 52.

Such facilitated manual operation is convenient especially when the remote control is misplaced or during a power failure.

This invention has been described above with reference to the preferred embodiment as shown in the figures. Modifications and alterations may become apparent to one skilled in the art upon reading and understanding the specification. Despite the use of one embodiment for illustration purposes, the invention is intended to include all such modifications and alterations within the spirit and scope of the appended claims.

What is claimed is:

1. A vertical blind comprising:

a hanger rail having a plurality of louvers hanging therefrom, each of said plurality of louvers being movable along said hanger rail and rotatable about a respective vertical axis;

a drive unit comprising:

a housing;

a louver traverse drive shaft rotatably mounted in said housing;

a louver tilt drive shaft rotatably mounted in said housing;

a loop string provided around said louver traverse drive shaft for traversing said plurality of louvers along said hanger rail;

a loop chain provided around said louver tilt drive shaft for rotating said plurality of louvers about a respective vertical axis;

a louver open detection means for detecting a neutral position of said plurality of louvers and said louver open detection means being located within said housing;

a control means for rotating said louver traverse drive shaft after said louver open detection means detects said neutral position of said plurality of louvers;

wherein said louver open detection means includes:

i) a slider which is slidable along an axial length of said louver tilt drive shaft in response to rotation of said louver tilt drive shaft; and ii) a switch is located adjacent said slider and is actuated by movement of said slider.

2. A drive unit for a vertical blind according to claim 1, wherein said slider has a thread groove matingly engaged with an external thread provided on said louver tilt drive shaft, such that when said louver tilt drive shaft rotates, said slider moves in an axial direction.

3. A drive unit for a vertical blind according to claim 2, wherein said slider and said switch are positioned relative to one another such that a change over point occurs when said louvers are in said neutral position, said change over point is defined by said switch switching from one of an ON to an OFF position and an OFF to an ON position.

4. A drive unit for a vertical blind according to claim 3, wherein said control means is adapted to rotate said louver tilt drive shaft until said change over point is detected and to subsequently rotate said louver traverse drive shaft.

5. A method for controlling a vertical blind, said vertical blind comprising a drive unit, a hanger rail hanging a plurality of louvers therefrom, a loop string for traversing said plurality of louvers and a loop chain for tilting said plurality of louvers, said method comprising the steps of:

wrapping said loop string around a louver traverse drive shaft rotatably mounted in a housing of said drive unit;

wrapping said loop chain around a louver tilt drive shaft rotatably mounted in said housing of said drive unit;

detecting a neutral position of said plurality of louvers with a louver open detection means, said louver open detection means having a slider being slidable along an axial length of said louver tilt drive shaft in response to rotation of said louver tilt drive shaft;

activating a switch by sufficient movement of said slider, said slider and said switch being positioned such that a change over occurs at said neutral position of said plurality of louvers, and said change over being defined by said switch switching from one of ON to OFF and OFF to ON position;

controlling, with controlling means, rotation of said louver traverse drive shaft and said louver tilt drive shaft whereby detection by said controlling means of said change over indicates that said plurality of louvers are at said neutral position; and stopping rotation of said louver tilt drive shaft, upon said controlling means detecting said change over, and rotating said louver traverse drive shaft.

* * * * *